US010308456B2

(12) United States Patent
Kanazawa

(10) Patent No.: US 10,308,456 B2
(45) Date of Patent: Jun. 4, 2019

(54) SHEET SUPPLIER

(71) Applicant: BROTHER KOGYO KABUSHIKI KAISHA, Nagoya-shi, Aichi-ken (JP)

(72) Inventor: Gakuro Kanazawa, Toyokawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/939,596

(22) Filed: Mar. 29, 2018

(65) Prior Publication Data

US 2018/0282087 A1 Oct. 4, 2018

(30) Foreign Application Priority Data

Mar. 30, 2017 (JP) ..... 2017-067534

(51) Int. Cl.
*B65H 3/06* (2006.01)
*B65H 3/52* (2006.01)
(Continued)

(52) U.S. Cl.
CPC ..... *B65H 3/5261* (2013.01); *B41J 13/02* (2013.01); *B41J 13/10* (2013.01); *B65H 3/0638* (2013.01); *B65H 3/0653* (2013.01); *B65H 3/0684* (2013.01); *B65H 3/5215* (2013.01); *B65H 3/5223* (2013.01); *B65H 3/56* (2013.01); *B65H 2301/152* (2013.01); *B65H 2301/423245* (2013.01); *B65H 2404/15* (2013.01);
(Continued)

(58) Field of Classification Search
CPC ..... B65H 3/5215; B65H 3/0653; B65H 2405/1118; B65H 2405/111
See application file for complete search history.

(56) References Cited

U.S. PATENT DOCUMENTS 6,227,535 B1 * 5/2001 Bae ..... B65H 3/5215 271/121
7,976,014 B2 * 7/2011 Kobayashi ..... B41J 3/543 271/119
(Continued)

FOREIGN PATENT DOCUMENTS

JP 11-116083 A 4/1999
JP 2000-159368 A 6/2000
(Continued)

*Primary Examiner* — Jeremy R Severson
(74) *Attorney, Agent, or Firm* — Merchant & Gould P.C.

(57) ABSTRACT

A sheet supplier, including: a tray including a sheet support surface; a sheet supply roller configured to supply an uppermost one of sheets; a rotational member configured to contact a lowermost one of the sheets; a presser configured to press the supply roller relative to the rotational member; and a supporter configured to support the rotational member by a contact portion such that the rotational member is rotated by a movement of the lowermost sheet and to limit a movement of the rotational member caused by a force of the lowermost sheet in a sheet supply direction; wherein, where static friction coefficients between the supply roller and the uppermost sheet, between the sheets on the support surface, between the rotational member and the lowermost sheet, and between the rotational member and the contact portion are respectively defined as μ2, μ3, and μ4, the following expressions are satisfied: μ1>μ4>μ2, μ3>μ4.

7 Claims, 9 Drawing Sheets

(51) Int. Cl.
*B41J 13/10* (2006.01)
*B41J 13/02* (2006.01)
*B65H 3/56* (2006.01)

(52) U.S. Cl.
CPC .. *B65H 2404/25* (2013.01); *B65H 2405/1118* (2013.01); *B65H 2405/1136* (2013.01); *B65H 2515/815* (2013.01)

(56) References Cited

U.S. PATENT DOCUMENTS

| | | | | |
|---|---|---|---|---|
| 7,980,554 | B2 * | 7/2011 | Eltzroth | B65H 3/56 271/121 |
| 8,915,496 | B2 * | 12/2014 | Hung | B65H 3/0653 271/121 |
| 9,051,141 | B2 * | 6/2015 | Kato | B65H 1/022 |
| 2004/0251592 | A1 * | 12/2004 | Ruhe | B41J 11/0025 271/109 |
| 2006/0267266 | A1 * | 11/2006 | Shao | B65H 1/00 271/113 |

FOREIGN PATENT DOCUMENTS

| | | | |
|---|---|---|---|
| JP | 2006-117384 | A | 5/2006 |
| JP | 2006-168840 | A | 6/2006 |

* cited by examiner

SHEET SUPPLIER

CROSS REFERENCE TO RELATED APPLICATION

The present application claims priority from Japanese Patent Application No. 2017-067534, which was filed on Mar. 30, 2017, the disclosure of which is herein incorporated by reference in its entirety.

BACKGROUND

Technical Field

The following disclosure relates to a sheet supplier configured to supply sheets.

Description of Related Art

There is known a sheet supplier including: a sheet supply roller (pickup roller) configured to contact an uppermost one of sheets stacked on a tray and to rotate; and a separation pad disposed so as to be opposed to the sheet supply roller. The sheet supplier enables the uppermost sheet to be separated from other sheets thereunder and to supply only the uppermost sheet when the sheet supply roller is rotated, by adjusting a frictional force between the separation pad and a lowermost one of the sheets and a frictional force between the sheet supply roller and the uppermost sheet.

SUMMARY

In a case where a plurality of sheets are placed on the tray of the sheet supplier constructed as described above, a static frictional force between the separation pad and the lowermost sheet needs to be larger than a static frictional force between the sheets, for separating the uppermost sheet from the other sheets thereunder. In a case where only a single sheet is placed on the tray, however, an increase in the static frictional force between the separation pad and the lowermost sheet causes a risk that the sheet fails to be supplied due to the static frictional force between the sheet and the separation pad. For instance, a sheet which is glossy on its surface, such as a sheet used for photo printing, a transfer seal or the like, has a relatively large friction coefficient on the surface, so that such a risk tends to be caused.

Accordingly, one aspect of the present disclosure relates to a sheet supplier capable of appropriately supplying sheets even in a situation in which only a single sheet is placed on a tray while preventing an occurrence of multiple feeding of sheets.

In one aspect of the disclosure, a sheet supplier includes: a tray including a support surface configured to support a plurality of sheets; a sheet supply roller configured to supply, in a sheet supply direction, a first sheet which is an uppermost one of the plurality of sheets supported on the support surface by rotating about a roller shaft while the sheet supply roller is held in contact with the first sheet; a rotational member configured to be rotatable and to be held in contact with a second sheet which is a lowermost one of the plurality of sheets supported on the support surface in a state in which the plurality of sheets are interposed between the rotational member and the sheet supply roller; a presser configured to press the sheet supply roller relative to the rotational member; and a supporter including a contact portion contacting the rotational member, the supporter being configured to support the rotational member by the contact portion such that the rotational member is rotated by a movement, in the sheet supply direction, of the second sheet with which the rotational member is held in contact and to limit a movement of the rotational member caused by a force of the second sheet in the sheet supply direction; wherein, where a static friction coefficient between the sheet supply roller and the first sheet is defined as $\mu 1$, a static friction coefficient between the plurality of sheets supported on the support surface is defined as $\mu 2$, a static friction coefficient between the rotational member and the second sheet is defined as $\mu 3$, and a static friction coefficient between the rotational member and the contact portion of the supporter is defined as $\mu 4$, the following expressions are satisfied: $\mu 1>\mu 4>\mu 2$, $\mu 3>\mu 4$.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF EMBODIMENTS

Hereinafter, there will be described a printer 1 having a sheet supplier according to one embodiment. The printer 1 is normally used in a state shown in FIG. 1. In the following explanation, an upper side and a lower side are defined in this state. A front side and a rear side are defined by regarding a surface of the printer 1 on which an opening 11 is formed as a front surface, and a right side and a left side are defined in a state in which the printer 1 is seen from the front side. A front-rear direction and a right-left direction are parallel to a horizontal plane, and an up-down direction is a vertical direction perpendicular to the horizontal plane.

Figure 1:
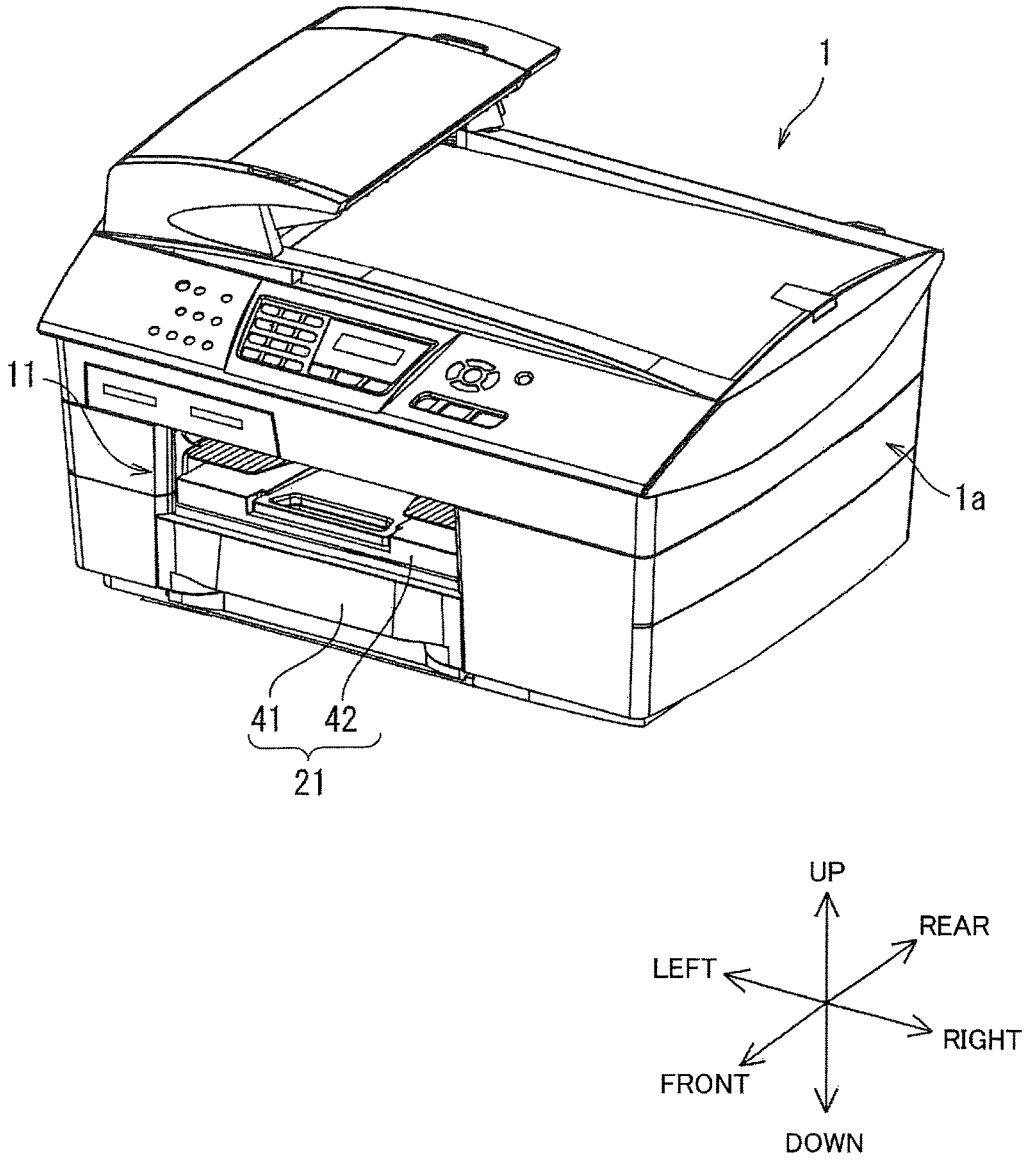
FIG. 1 is an external perspective view of an ink-jet printer according to one embodiment.

As shown in FIG. 1, the printer 1 includes a housing 1*a* shaped like a generally rectangular parallelepiped. The opening 11 is formed on a front wall of the housing 1*a* so as to be located at a central portion of the front wall in the right-left direction. A sheet supply cassette 21 of a sheet supplier 2 is mounted to a lower portion of the opening 11.

Figure 2:
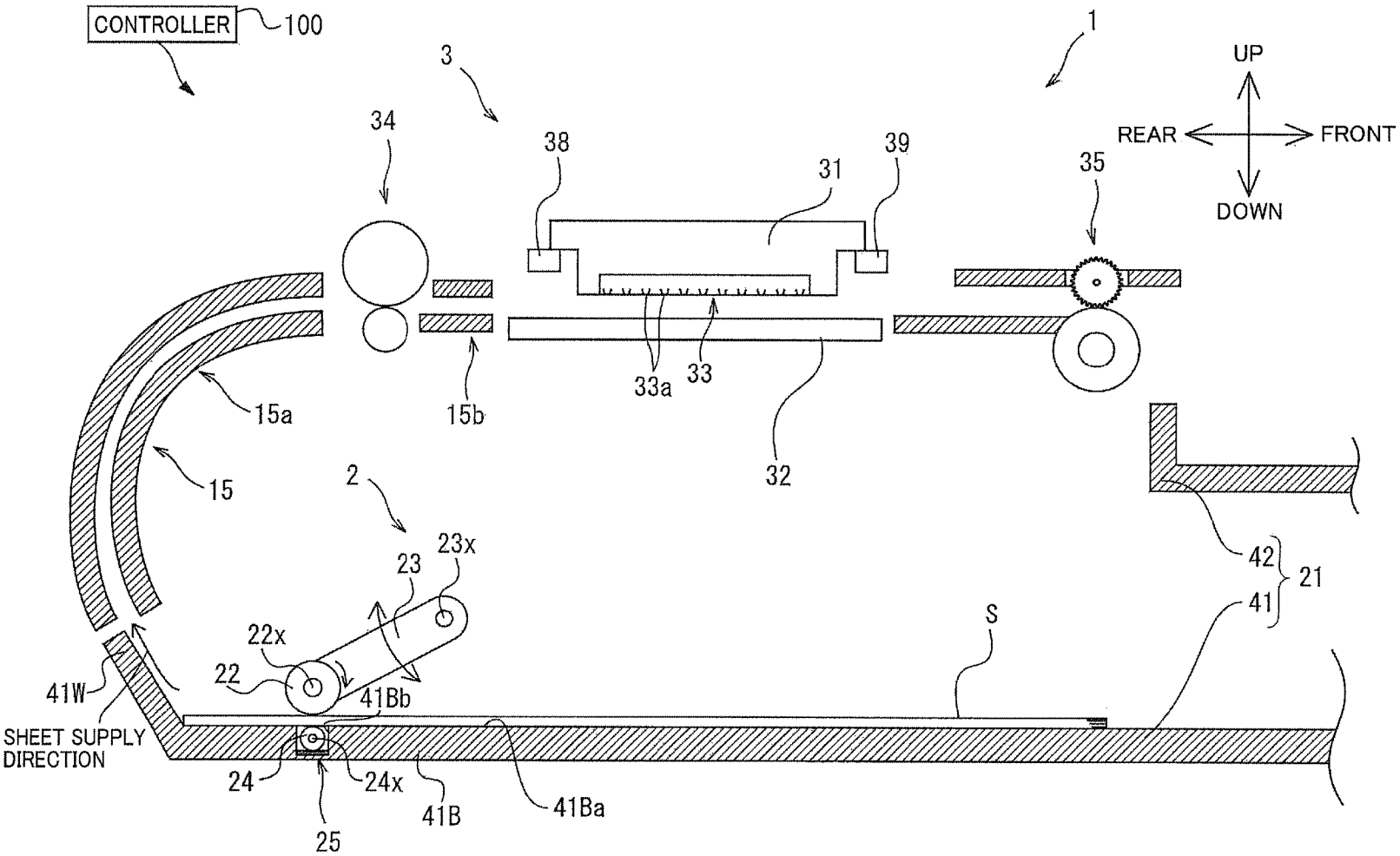
FIG. 2 is a schematic vertical cross-sectional view of the ink-jet printer.

As shown in FIG. 2, there are housed, in the housing 1*a*, the sheet supplier 2, a printer portion 3, a controller 100, and so on. The sheet supplier 2 is configured to supply sheets S stacked on a sheet supply tray 41 of the sheet supply cassette 21 to the printer portion 3 via a conveyance path 15. The sheet supplier 2 will be later explained in detail.

The conveyance path 15 has a generally C-like shape in side view and is formed by a pair of guides that are opposed to each other with a suitable spacing interposed therebetween. The conveyance path 15 includes: a curved path 15*a* which is connected to a rear end portion of the sheet supply tray 41 so as to extend therefrom upward while curving toward the front side; and a straight path 15*b* which is connected to the curved path 15*a* and which extends substantially straight in the front-rear direction toward a sheet discharge tray 42.

The printer portion 3 is an ink-jet printing device configured to print an image on the sheet S supplied by the sheet supplier 2. The printer portion 3 includes a carriage 31, a platen 32, an ink-jet head 33, and conveyance roller pairs 34, 35. The carriage 31 is supported, above the straight path 15*b*, by two guide rails 38, 39 extending in the right-left direction. The carriage 31 is configured to reciprocate in the right-left direction. When a carriage moving device (not shown) is driven under the control of the controller 100, the carriage 31 moves along the guide rails 38, 39 in the right-left direction.

The platen 32 is disposed below the carriage 31. The platen 32 supports, from below, the sheet S supplied from the sheet supplier 2. The ink-jet head 33 is mounted on the carriage 31 and is configured to move in the right-left direction, together with the carriage 31. The ink-jet head 33 has a plurality of nozzles 33*a* formed in its lower surface. Ink is ejected from the nozzles 33*a* toward the sheet S supported by the platen 32.

The conveyance roller pairs 34, 35 are disposed such that the platen 32 is interposed therebetween in the front-rear direction. The two conveyance roller pairs 34, 35 are driven in synchronization with each other by a conveyance motor (not shown). When the two conveyance roller pairs 34, 35 are driven, the sheet S supported on the platen 32 is conveyed frontward along the straight path 15*b*.

The controller 100 includes a central processing unit (CPU), a read only memory (ROM), a random access memory (RAM), an application specific integrated circuit (ASIC), which cooperate to control operations of the sheet supplier 2 and the printer portion 3, for instance.

For instance, the controller 100 controls the sheet supplier 2 to execute a sheet supplying processing for supplying the sheet S to the printer portion 3. Further, the controller 100 controls the printer portion 3 to execute a printing processing by alternatingly performing: an ejection operation in which ink is ejected from the nozzles 33*a* of the ink-jet head 33 toward the sheet S on the platen 32 during one movement of the carriage 31 in the scanning direction; and a conveyance operation in which the conveyance roller pairs 34, 35 convey the sheet S frontward by a predetermined distance, for printing an image on the sheet S.

The sheet supplier 2 will be next explained in detail. As shown in FIG. 2, the sheet supplier 2 includes the sheet supply cassette 21, a sheet supply roller 22, an arm 23, a rotation roller 24, and a supporter 25.

The sheet supply cassette 21 includes: the sheet supply tray 41 capable of storing a plurality of sheets S; and the sheet discharge tray 42 which is disposed over the sheet supply tray 41 and to which is discharged the sheet S on which an image has been printed by the printer portion 3.

The sheet supply tray 41 is shaped like a box opening upward. An upper surface of a bottom wall 41B of the sheet supply tray 41 is a support surface 41Ba on which a stack of a plurality of sheets S can be placed. The sheet supply tray 41 is capable of storing sheets of a plurality of types such as plain paper, glossy paper, transfer paper for iron printing and the like.

The arm 23 is supported by a housing 1*a* (as one example of "support portion") such that the arm 23 is pivotable about a pivot shaft 23*x* provided at its basal portion. The pivot shaft 23*x* extends in the right-left direction and is disposed at a height level higher than the support surface 41Ba of the sheet supply tray 41 in the up-down direction.

A roller shaft 22*x* extending in the right-left direction is provided at a distal portion of the arm 23. The sheet supply roller 22 is rotatable about the roller shaft 22*x*. A range over which the arm 23 is pivoted is set such that a lower limit of the range is defined by the support surface 41Ba of the sheet supply tray 41 (the rotation roller 24), so as to permit the distal portion of the arm 23 to be always located more rearward than the basal portion thereof. Thus, the roller shaft 22*x* of the sheet supply roller 22 is always located more rearward than the pivot shaft 23*x*. Further, the pivot shaft 23*x* is disposed at a height level higher than the roller shaft 22*x*, namely, the pivot shaft 23*x* is located farther from the support surface 41B than the roller shaft 22*x*.

A position of the center of gravity of the arm 23 is located at a position of the arm 23 nearer to the distal portion than to the basal portion. With this configuration, there is generated, in the arm 23, a rotational torque by its own weight in a direction in which the distal portion is located right under the pivot shaft 23*x*. That is, the arm 23 is biased in a direction in which the distal portion of the arm 23 gets closer to the support surface 41Ba (the rotation roller 24). Thus, the sheet supply roller 22 provided at the distal portion of the arm 23 contacts an uppermost one of the plurality of sheet S stacked on the support surface 41Ba of the sheet supply tray 41 and presses the uppermost sheet S. In this respect, the arm 23 may be biased by a spring in the direction in which the distal portion of the arm 23 gets closer to the support surface 41Ba.

A supply motor (not shown) is connected to the pivot shaft 23*x*. In the arm 23, a gear transmission mechanism (not shown) is provided for transmission of a drive force between the pivot shaft 23*x* and the roller shaft 22*x* of the sheet supply roller 22. The gear transmission mechanism includes a plurality of gears and planetary gears. Under the control of the controller 100, the supply motor is driven so as to rotate the pivot shaft 23*x*, so that the sheet supply roller 22 rotates clockwise in FIGS. 2 and 3. Thus, the uppermost one of plurality of sheets S placed on the support surface 41Ba is supplied in a direction toward the conveyance path 15. (Hereinafter, the direction will be referred to as "sheet supply direction".)

The sheet supply tray 41 includes a separation wall 41*w*. The separation wall 41*w* is constituted by one of four walls of the sheet supply tray 41 that is located downstream of the sheet supply roller 22 in the sheet supply direction (on the left side in FIG. 1). When a plurality of sheets S are supplied at one time in an overlapping state by rotation of the sheet supply roller 22, the separation wall 41*w* comes into contact with one of the sheets S which is farthest from the sheet supply roller 22 and gives the farthest sheet S to a resistance to conveyance, so as to separate the uppermost sheet S contacting the sheet supply roller 22 from other sheets S that have been supplied with the uppermost sheet. To this end, the separation wall 41*w* includes a separation member (not shown) attached thereto. The separation member may be a plate member formed of a material having a large frictional resistance such as cork or rubber or may be a member having a plurality of protrusions formed of resin or metal.

A recess 41Bb is formed in a bottom wall 41B of the sheet supply tray 41 at a position at which the recess 41Bb is opposed to the sheet supply roller 22 with the sheets S placed on the support surface 41Ba interposed therebetween. The recess 41Bb is open upward. A space in a rectangular parallelepiped shape is defined in the recess 41Bb.

The rotation roller 24 is accommodated in the space defined in the recess 41Bb. That is, the rotation roller 24 is opposed to the sheet supply roller 22 with the sheets S placed on the support surface 41Ba interposed therebetween. With this configuration, the rotation roller 24 receives a pressing force from the sheet supply roller 22 by the arm 23 biased as described above.

The rotation roller 24 is formed of rubber or the like having high hardness (e.g., not lower than 90 degrees) at which a friction coefficient is unlikely to change even if an applied pressure changes. An outer circumferential surface of the rotation roller 24 is held in contact with a lowermost one of the sheets S placed on the support surface 41Ba. The rotation roller 24 has a diameter smaller than a distance between a front wall and a rear wall of the recess 41Bb in the front-rear direction. A rotation shaft 24*x* of the rotation roller 24 protrudes at its opposite end portions outward from the roller body in the right-left direction. An upper end of the rotation roller 24 is located at a height level higher than the support surface 41Ba.

Figure 3:
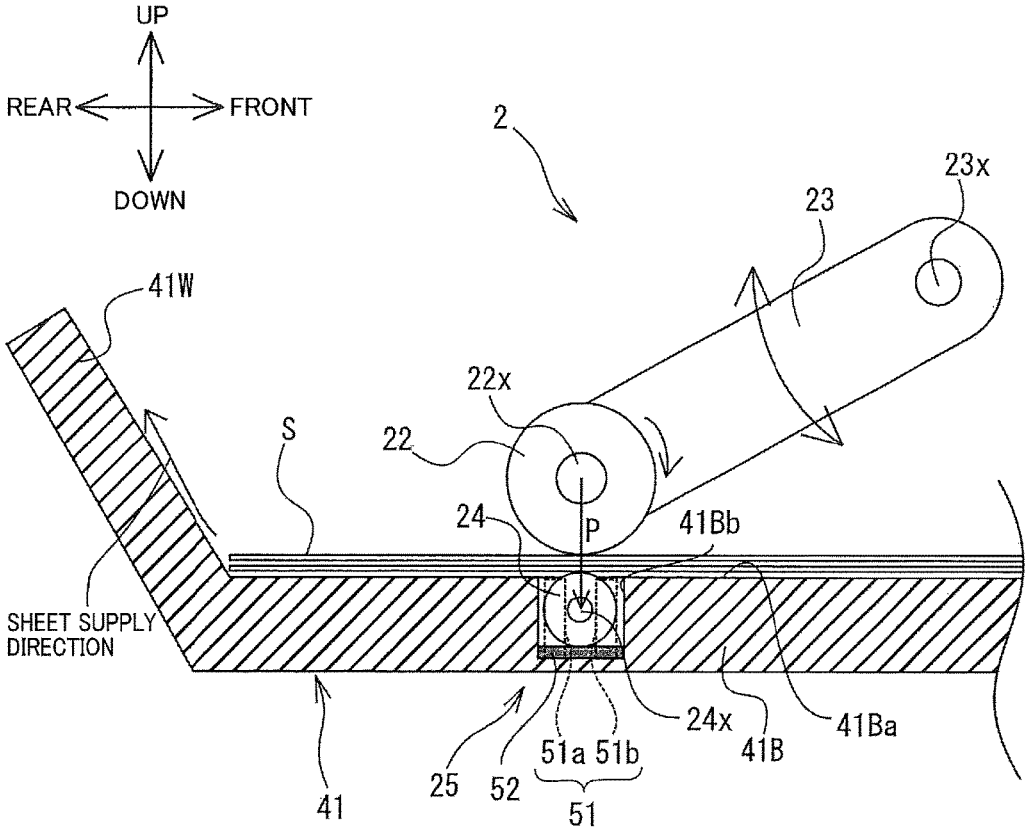
FIG. 3 is a fragmentary sectional view of a sheet supplier.

The supporter 25 supports the rotation roller 24 such that the rotation roller 24 is rotated by a movement, in the sheet supply direction, of the sheet S with which the rotation roller 24 is held in contact. As shown in FIG. 3, the supporter 25 includes two pairs of stoppers 51 (only one of which is illustrated in FIG. 3) and a friction pad 52. The two pairs of stoppers 51 are disposed so as to sandwich the roller body of the rotation roller 24 therebetween in the right-left direction. Each stopper 51 includes a pair of stopper walls 51*a*, 51*b*. Each stopper wall 51*a*, 51*b* is a vertical wall extending upward from a bottom surface of the recess 41Bb. The stopper walls 51*a*, 51*b* are disposed so as to sandwich the rotation shaft 24*x* of the rotation roller 24 therebetween in the front-rear direction. A distance by which the stopper walls 51*a*, 51*b* are spaced apart from each other in the front-rear direction is larger than a diameter of the rotation shaft 24*x* and is smaller than the diameter of the rotation roller 24. The two pairs of stoppers 51 limit a movement of the rotation shaft 24*x* in the front-rear direction (i.e., a movement in the sheet supply direction and a movement in a direction opposite to the sheet supply direction) while allowing a movement of the rotation shaft 24*x* in the up-down direction. In other words, the two pairs of stoppers 51 limit a movement of the rotation roller 24 in the front-rear direction while allowing a movement of the rotation roller 24 in the up-down direction (i.e., a direction of pressing contact of the sheet supply roller 22 with respect to the rotation roller 24). Further, the two pairs of stoppers 51 position the rotation roller 24 such that the outer circumferential surface of the rotation roller 24 does not come into contact with the front wall and the rear wall of the recess 41Bb.

In the present embodiment, in a state in which no sheets S are placed on the sheet supply tray 41, the sheet supply roller 22 and the rotation roller 24 are held in contact with each other, and a position of the roller shaft 22*x* of the sheet supply roller 22 in the front-rear direction is the same as a position of the rotation shaft 24*x* of the rotation roller 24 in the front-rear direction.

The friction pad 52 is shaped like a plate. The friction pad 52 is disposed on the bottom surface of the recess 41Bb so as to support the rotation roller 24 from below. That is, the friction pad 52 is held in contact with the outer circumferential surface of the rotation roller 24. The friction pad 52 is formed of felt or the like having a small frictional resistance. The friction pad 52 has a friction coefficient smaller than that of a printing surface of each of the sheets S of every type placed on the sheet supply tray 41. A load torque is given to the rotation roller 24 by the friction pad 52. Thus, the rotation roller 24 does not rotate until a certain rotation force is given to the rotation roller 24. As described above, the rotation roller 24 is allowed to move in the up-down direction. Consequently, when the sheet supply roller 22 applies the pressing force with respect to the rotation roller 24, the pressing force is transmitted to the friction pad 52 via the rotation roller 24.

With the configuration described above, when the sheet supply roller 22 is pressed with respect to the rotation roller 24 by the arm 23 in a state in which a plurality of sheets S are placed on the support surface 41Ba, the same magnitude of a normal force P is generated, based on a relationship of action and reaction, on a line of action connecting the roller shaft 22*x* and the rotation shaft 24*x* between the sheet supply roller 22 and the sheet S, between the sheets S placed on the support surface 41Ba, between the rotation roller 24 and the sheet S, and between the rotation roller 24 and the friction pad 52. That is, even when the pressing force applied to the rotation roller 24 from the sheet supply roller 22 changes, the same magnitude of the normal force P is generated between the sheet supply roller 22 and the sheet S, between the sheets S placed on the support surface 41Ba, between the rotation roller 24 and the sheet S, and between the rotation roller 24 and the friction pad 52.

The sheet supplier 2 according to the present embodiment has a function of preventing the sheets S from being supplied at one time, namely, preventing multiple feeding of the sheets S, in the state in which the plurality of sheets S are placed on the support surface 41Ba of the sheet supply tray 41, by a rotation torque of the rotation roller 24. Further, in a state in which only a single sheet S is placed on the support surface 41Ba, a rotation force larger than the load torque described above is given to the rotation roller 24 when the sheet supply roller 22 rotates. Thus, the sheet supplier 2 has a function of supplying the sheet S by rotating the rotation roller 24 by a movement of the sheet S in the sheet supply direction. To achieve these functions, there is determined a value relationship among a static friction coefficient $\mu 1$ between the sheet supply roller 22 and the sheet S, a static friction coefficient $\mu 2$ between the sheets S placed on the support surface 41Ba, a static friction coefficient $\mu 3$ between the rotation roller 24 and the sheet S, and a static friction coefficient $\mu 4$ between the rotation roller 24 and the friction pad 52.

Before explaining the static friction coefficients in the sheet supplier 2 of the present embodiment, there will be explained a structure of a conventional sheet supplier 200 by referring to FIG. 4.

The conventional sheet supplier 200 has a friction pad 250 disposed on the bottom wall 41B, instead of the rotation roller 24 and the supporter 25 of the sheet supplier 2 of the present embodiment. The friction pad 250 is a plate member formed of a material having a large frictional resistance (such as cork or rubber). The friction pad 250 is opposed to the sheet supply roller 22 with the sheets S placed on the support surface 41Ba interposed therebetween. The friction pad 250 is held in contact with a lowermost one of the plurality of sheets S placed on the support surface 41Ba. When the sheet supply roller 22 is pressed with respect to the friction pad 250 by the arm 23 in the state in which the plurality of the sheets S are placed on the support surface 41Ba, the same magnitude of the normal force P is generated between the sheet supply roller 22 and the sheet S, between the sheets S placed on the support surface 41Ba, and between the friction pad 250 and the sheet S. There will be next explained: a sheet supplying condition in a case where two sheets S, as one example of the plurality of sheets S, are placed on the support surface 41Ba of the sheet supplier 200; and a sheet supplying condition in a case where a single sheet S is placed on the support surface 41Ba. Further, a static friction coefficient between the friction pad 250 and the sheet S is defined as "static friction coefficient μ5".

Figure 4A:
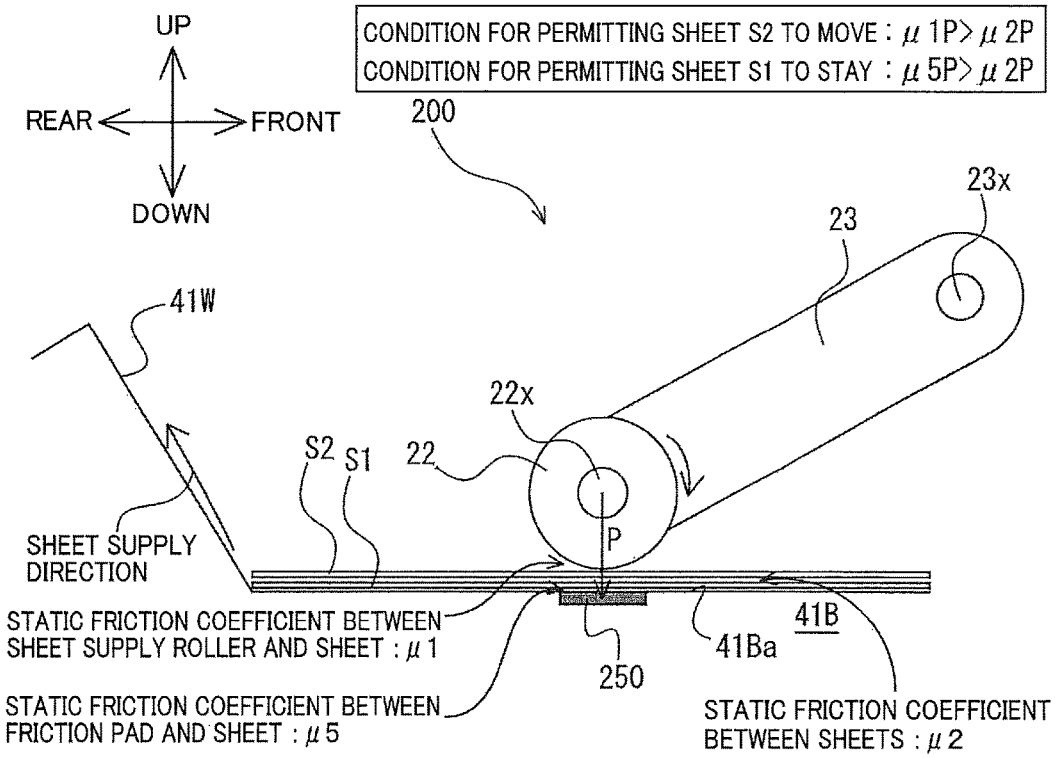
FIG. 4A is a view for explaining a sheet supplying condition in a known sheet supplier.

Initially, the sheet supplying condition in the case where two sheets S are placed on the support surface 41Ba of the sheet supplier 200 will be explained. As shown in FIG. 4A, an upper one of the two sheets S will be referred to as "sheet S2", and a lower one of the two sheets S will be referred to as "sheet S1".

For permitting the upper sheet S2 to be moved (supplied) by rotation of the sheet supply roller 22, a static frictional force (sheet supply force: μ1P) between the sheet supply roller 22 and the sheet S2 needs to be larger than a static frictional force (μ2P) between the sheet S1 and the sheet S2. On the other hand, for permitting the lower sheet S1 to stay without being moved, a static frictional force (μ5P between the sheet S1 and the friction pad 250 needs to be larger than the static frictional force (μ2P) between the sheet S1 and the sheet S2. Thus, the sheet supplying condition in the case where the two sheets S1, S2 are placed needs to include conditions represented by the following expressions (1) and (2):

$$\mu 1 > \mu 2 \quad (1)$$

$$\mu 5 > \mu 2 \quad (2)$$

Figure 4B:
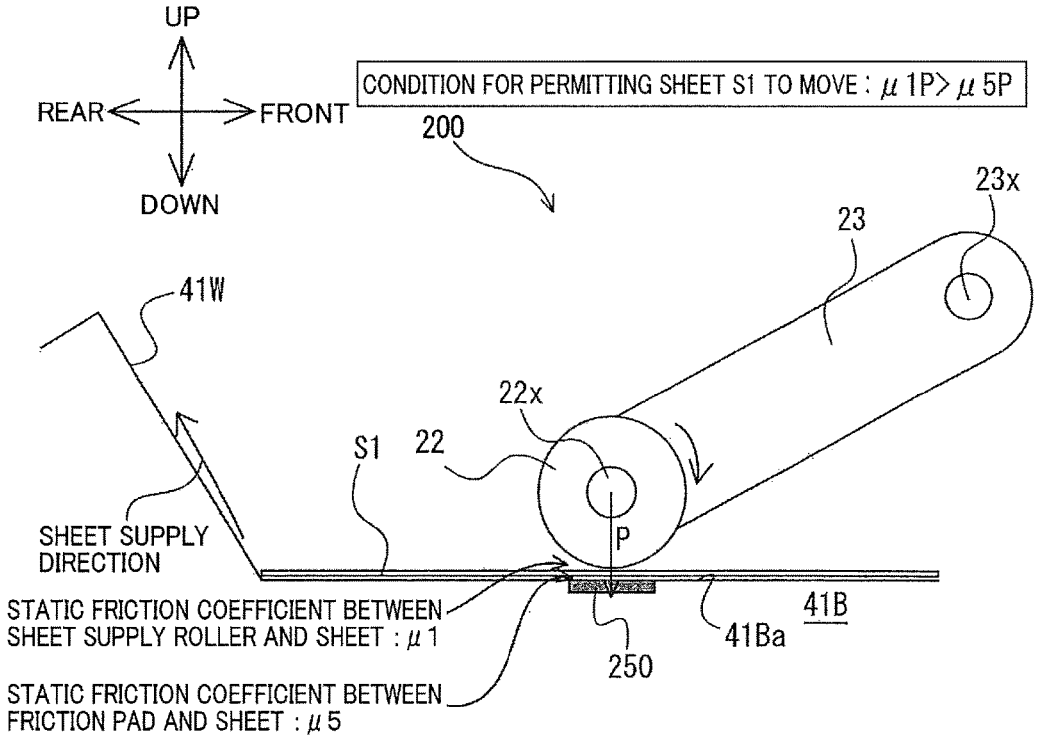
FIG. 4B is a view for explaining the sheet supplying condition in the known sheet supplier.

Next, the sheet supplying condition in the case where a single sheet S1 is placed on the support surface 41Ba will be explained. For permitting the sheet S1 to be moved by rotation of the sheet supply roller 22, a static frictional force (μ1P) between the sheet supply roller 22 and the sheet S1 needs to be larger than the static frictional force (μ5P between the sheet S1 and the friction pad 25, as shown in FIG. 4B. Thus, the sheet supplying condition in the case where the single sheet S1 is placed needs to include a condition represented by the following expression (3):

$$\mu 1 > \mu 5 \quad (3)$$

As described above, the conveyance path 15 has a generally C-like shape in side view. Accordingly, the sheet S is placed on the sheet supply tray 41 such that a printing surface of the sheet S on which an image is to be printed by the printer portion 3 faces toward the support surface 41Ba and a non-printing surface of the sheet S faces toward the sheet supply roller 22. The printing surface of glossy paper used for photo printing, a transfer seal or the like has a friction coefficient (frictional resistance) larger than that of the non-printing surface thereof. Accordingly, in a case where the glossy paper is placed on the sheet supply tray 41, the static friction coefficient μ5 between the friction pad 250 and the printing surface of the sheet S is larger than the static friction coefficient μ1 between the sheet supply roller 22 and the non-printing surface of the sheet S, so that there may arise a possibility that the condition represented by the above expression (3) is not satisfied. Consequently, in the case where a single sheet of the glossy paper is placed on the sheet supply tray 41, the single sheet of the glossy paper cannot be supplied.

For enabling the single sheet of the glossy paper to be supplied even in the case where the single sheet of the glossy paper is placed on the sheet supply tray 41, it may be considered that the friction pad 250 is formed of a material having a small frictional resistance so as to decrease the static friction coefficient μ5. In this case, however, the condition represented by the above expression (2) is not satisfied depending upon the type of the sheets S (e.g., plain paper) stored in the sheet supply tray 41. As a result, in the case where the two sheets S are placed on the sheet supply tray 41, there may be a risk that the two sheets S are supplied at one time when the sheet supply roller 22 rotates, namely, the multiple feeding of the sheets S may occur. Thus, the static friction coefficient μ5 changes depending upon the type of the sheets S placed on the sheet supply tray 41. It is therefore very difficult to satisfy all of the conditions represented by the above expressions (1)-(3) for all types of the sheets S that can be placed on the sheet supply tray 41.

When the last one of the plurality of sheets S placed on the sheet supply tray 41, namely, the sheet S1, is supplied in the conventional sheet supplier 200, the sheet S1 is supplied while being in rubbing contact with the friction pad 250, resulting in a damage to the printing surface of the sheet S1 or causing a large rubbing noise.

In contrast, the sheet supplier 2 of the present embodiment includes the rotation roller 24 and the supporter 25, in place of the friction pad 250. In the sheet supplier 2, the value relationship among the static friction coefficients μ1-μ4 is appropriately set. Thus, the sheet supplier 2 enables good conveyance even when only a single sheet S is placed on the sheet supply tray 41 while the sheet supplier 2 prevents or reduces an occurrence of the multiple feeding of the sheets S, irrespective of what type of the sheets S are placed on the sheet supply tray 41. The sheet supplier 2 will be explained in detail.

Figure 5A:
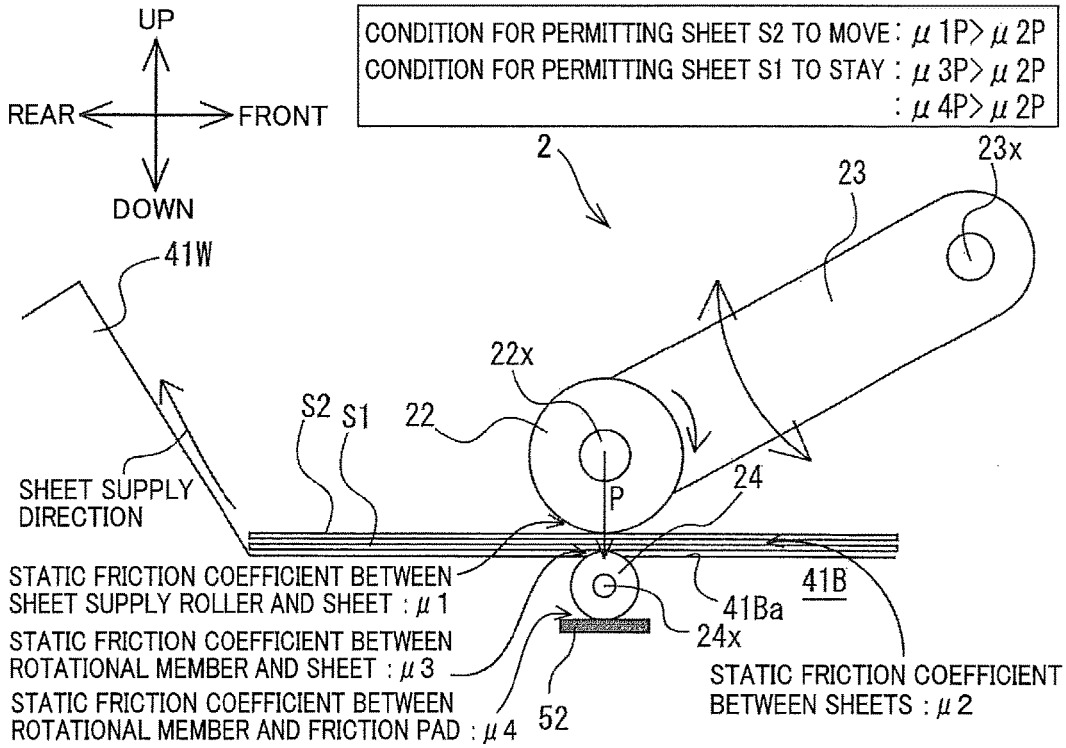
FIG. 5A is a view for explaining a sheet supplying condition in the sheet supplier according to the embodiment.
Figure 5B:
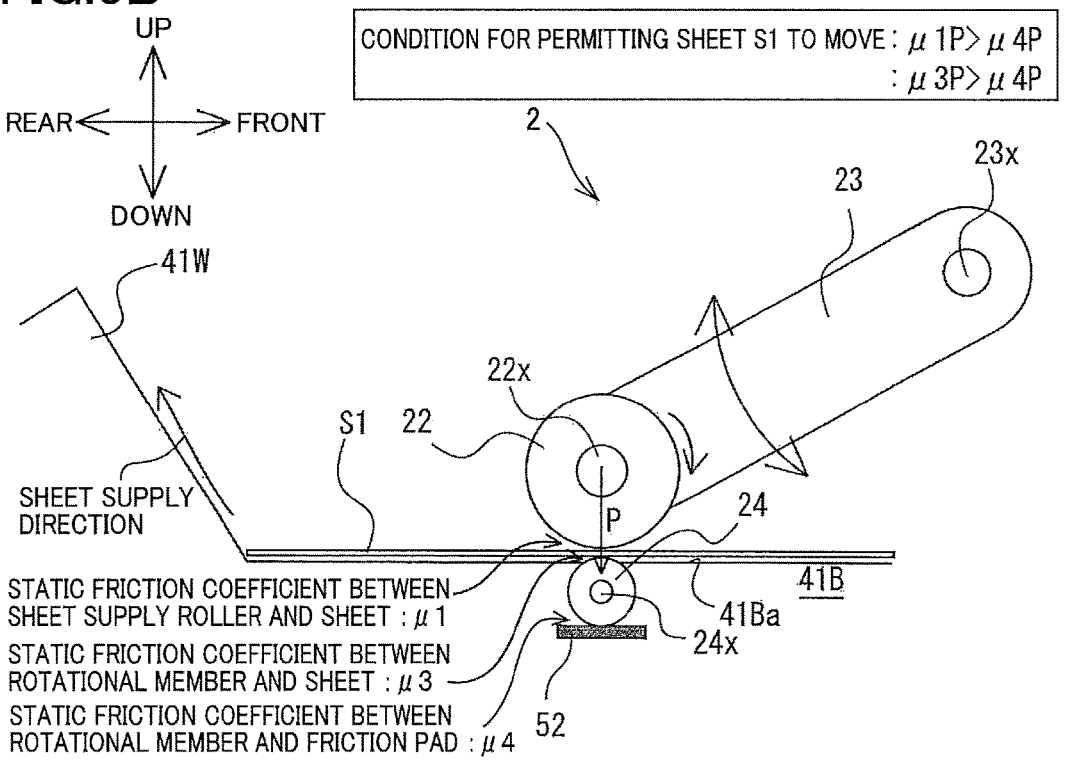
FIG. 5B is a view for explaining the sheet supplying condition in the sheet supplier according to the embodiment.

Initially, there will be explained a sheet supplying condition in a case where the two sheets S1, S2 are placed on the support surface 41Ba of the sheet supplier 2 according to the present embodiment. As shown in FIG. 5A, for permitting the upper sheet S2 to be moved by rotation of the sheet supply roller 22, the static frictional force (μ1P) between the sheet supply roller 22 and the sheet S2 needs to be larger than the static frictional force (μ2P) between the sheet S1 and the sheet S2.

On the other hand, for permitting the lower sheet S1 to stay without being moved, a static frictional force (μ3P) between the sheet S1 and the rotation roller 24 needs to be larger than the static frictional force (μ2P) between the sheet S1 and the sheet S2. As described above, in the present embodiment, the multiple feeding of the sheets S is prevented by the rotation torque of the rotation roller 24. That is, a static frictional force (μ4P) between the rotation roller 24 and the friction pad 52 is made larger than the static frictional force (μ2P) between the sheet S1 and the sheet S2, so as to make the load torque larger than the rotation force that is given to the rotation roller 24. Accordingly, the sheet supplying condition in the case where the two sheets S1, S2 are placed includes conditions represented by the following expressions (4) and (5), in addition to the above expression (1):

$$\mu3>\mu2 \quad (4)$$

$$\mu4>\mu2 \quad (5)$$

Next, there will be explained a sheet supplying condition in a case where a single sheet S1 is placed on the support surface 41Ba. In this instance, by giving, to the rotation roller 24, the rotation force not smaller than the load torque, the rotation roller 24 is rotated by a movement of the sheet S in the sheet supply direction. Accordingly, both of: the static frictional force (μ1P) between the sheet supply roller 22 and the sheet S1; and the static frictional force (μ3P) between the rotation roller 24 and the sheet S1 need to be larger than the static frictional force (μ4P) between the rotation roller 24 and the friction pad 52. Thus, the sheet supplying condition when the single sheet S1 is placed need to include conditions represented by the following expressions (6) and (7):

$$\mu1>\mu4 \quad (6)$$

$$\mu3>\mu4 \quad (7)$$

Summing up the expressions (1) and (4)-(7), it is needed to satisfy the condition represented by the expression (7) and a condition represented by the following expression (8):

$$\mu1>\mu4>\mu2 \quad (8)$$

The static friction coefficient μ3 is the static friction coefficient between the rotation roller 24 and the sheet S, and the static friction coefficient μ4 is the static friction coefficient between the rotation roller 24 and the friction pad 52. It is accordingly possible to satisfy the condition represented by the expression (7) by setting the friction coefficient of the friction pad 52 to be smaller than the friction coefficient of the printing surface of any type of the sheets S placed on the sheet supply tray 41.

The static friction coefficient μ4 is the static friction coefficient between the rotation roller 24 and the friction pad 52 and does not depend on the type of the sheets S placed on the sheet supply tray 41. It is thus possible to set the static friction coefficient μ4 to be larger than the static friction coefficient μ2 between the printing surface and the non-printing surface of any type of the sheets S placed on the sheet supply tray 41. Further, by setting the friction coefficient of the sheet supply roller 22 to be larger than the friction coefficient of the non-printing surface of any type of the sheets S placed on the sheet supply tray 41, it is possible to set the static friction coefficient μ1 to be larger than the static friction coefficient μ2. Consequently, the expression (8) can be satisfied.

Thus, the static friction coefficients μ1-μ4 can satisfy the conditions represented by the above expressions (7) and (8) irrespective of what type of the sheets S are placed on the sheet supply tray 41. In the present embodiment, the respective friction coefficients of the sheet supply roller 22, the rotation roller 24, and the friction pad 52 are set so as to satisfy the conditions represented by the expressions (7) and (8).

For example, the static friction coefficient μ2 between the sheets S placed on the sheet supply tray 41 is 0.2 for plain paper and 0.8 for glossy paper. Thus, the static friction coefficient μ2 is set to fall within a range of 0.2-0.8. Accordingly, the static friction coefficient μ1 is set to fall within a range of 1.3-2.0, the static friction coefficient μ3 is set to fall within a range of 1.3-2.0, and the static friction coefficient μ4 is set to fall within a range of 0.8-1.3.

According to the present embodiment, the static friction coefficients μ1-μ4 are set to satisfy the conditions represented by the expressions (7) and (8). In the state in which the plurality of sheets S are placed on the sheet supply tray 41, even when the sheet supply roller 22 is rotated while being held in contact with the uppermost sheet S, the lowermost sheet S is not supplied or moved owing to the rotation torque of the rotation roller 24. In this instance, even in a case where three or more sheets S are placed on the sheet supply tray 41 and a plurality of sheets S other than the lowermost sheet S are supplied at one time, the sheets S are separated by the separation wall 41*w*, so that the multiple feeding of the sheets S can be prevented.

In the state in which only a single sheet S is placed on the sheet supply tray 41, the rotation roller 24 is rotated by the sheet supply force given to the sheet S by rotation of the sheet supply roller 22, whereby the single sheet S can be supplied. When the single sheet S is supplied, the rotation roller 24 is rotated by the movement of the sheet S, making is possible to prevent the single sheet S from being damaged and to prevent a large rubbing noise from being generated.

In the embodiment explained above, the arm 23 is one example of "presser", the rotation roller 24 is one example of "rotational member", and the friction pad 52 is one example of "contact portion".

Modified Embodiments

There will be next explained sheet suppliers according to various modified embodiments. In the following modified embodiments, the same reference signs as used in the illustrated embodiment are used to identify the corresponding components and functional portions, and a detailed explanation thereof is dispensed with.

Figure 6A:
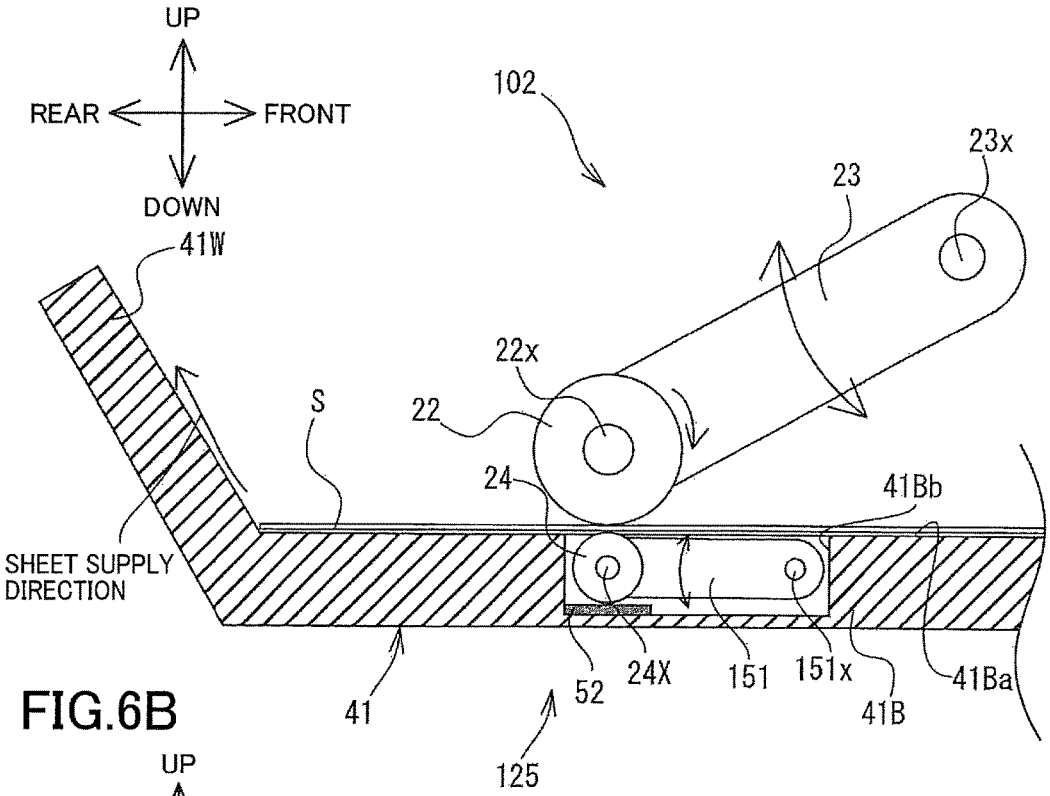
FIG. 6A is a fragmentary sectional view of a sheet supplier according to a modified embodiment.

A sheet supplier 102 shown in FIG. 6A will be explained. The sheet supplier 102 differs from the sheet supplier 2 in the structure of the supporter supporting the rotation roller 24. A supporter 125 of the sheet supplier 102 includes an arm 151, in place of the two pairs of the stoppers 51. The arm 151 is accommodated in the recess 41Bb. The arm 151 is supported by side walls of the recess 41Bb so as to be pivotable about a pivot shaft 151*x* provided at a basal portion of the arm 151. The pivot shaft 151*x* extends in the right-left direction.

The rotation shaft 24*x* of the rotation roller 24 is disposed at a distal portion of the arm 151, and the rotation roller 24 is rotatably supported by the rotation shaft 24*x*. In the sheet supplier 102 according to this modified embodiment, the arm 151 allows a movement of the rotation roller 24 in the up-down direction which is a direction of a pivotal movement of the arm 151 while limiting a movement of the rotation roller 24 in the front-rear direction. Consequently, when the sheet supply roller 22 applies the pressing force to the rotation roller 24, the arm 151 is pivoted, and the pressing force can be transmitted to the friction pad 52 via the rotation roller 24.

Figure 6B:
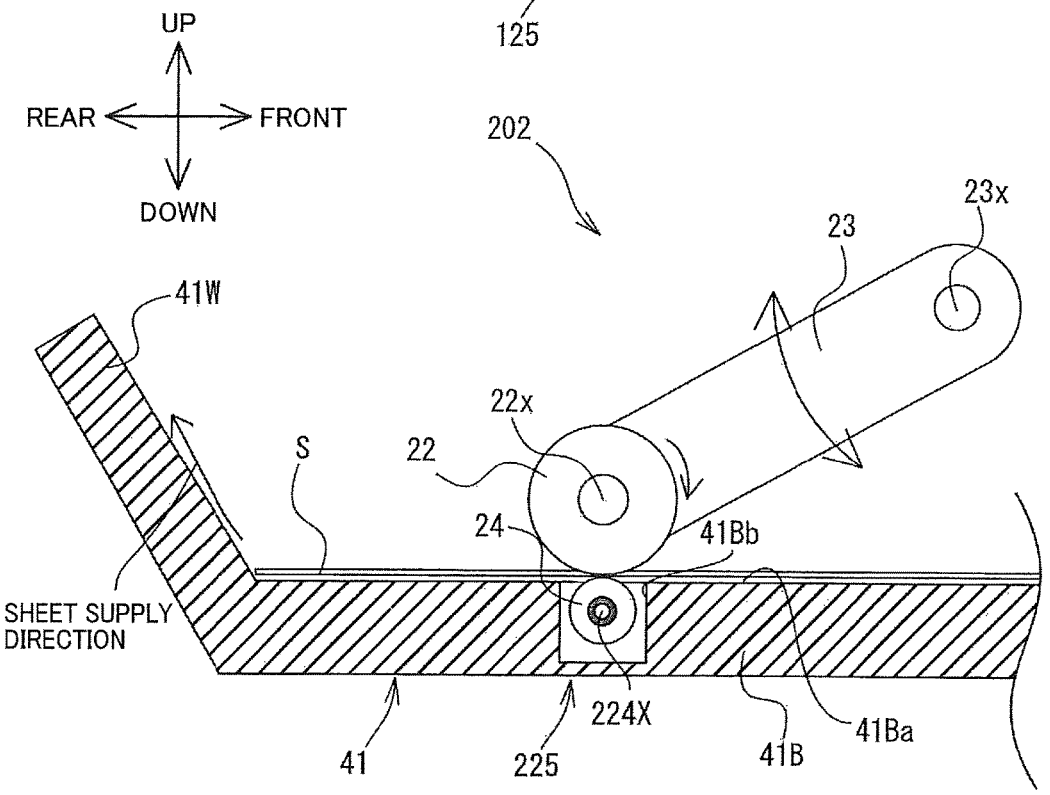
FIG. 6B is a fragmentary sectional view of a sheet supplier according to a modified embodiment.

A sheet supplier 202 shown in FIG. 6B will be explained. The sheet supplier 202 differs from the sheet supplier 2 in the structure of the supporter supporting the rotation roller 24. A supporter 225 of the sheet supplier 202 does not include the friction pad 52. Instead, the supporter 225 includes a rotation shaft 224X fixed to the housing 1*a*. The rotation roller 24 is rotatably supported by the rotation shaft 224X. An outer circumferential surface of the rotation shaft 224X is processed to have a predetermined frictional resistance for giving the load torque to the rotation roller 24. Specifically, the conditions represented by the expressions (7) and (8) are satisfied by using, as the static friction coefficient μ4, a static friction coefficient between the rotation roller 24 and the rotation shaft 224X. With this configuration, the sheet supplier 202 offers advantages similar to those in the illustrated embodiment. In this modified embodiment, the rotation shaft 224X is one example of "contact portion".

Figure 7A:
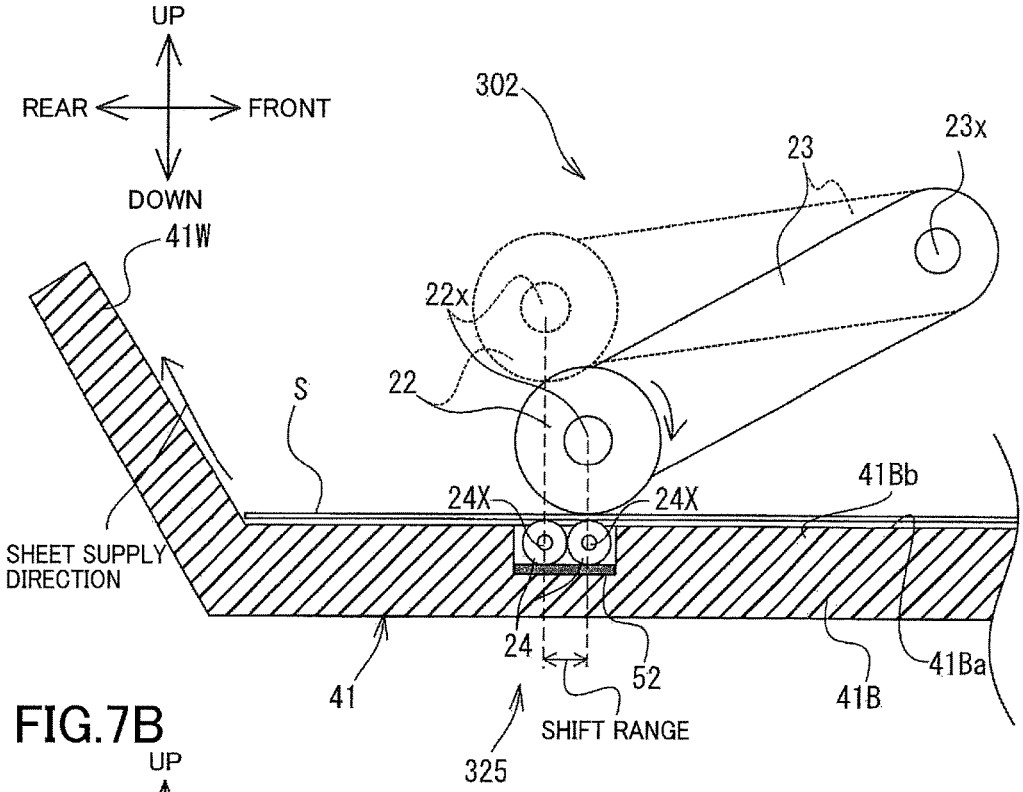
FIG. 7A is a fragmentary sectional view of a sheet supplier according to a modified embodiment.

A sheet supplier 302 shown in FIG. 7A will be explained. The sheet supply roller 22 is held in contact with an uppermost one of the plurality of sheets S placed on the support surface 41Ba. When the number of the sheets S placed on the support surface 41Ba changes, a position of the arm 23 in the up-down direction changes as a result of the pivotal movement of the arm 23 about the pivot shaft 23*x*. Accordingly, when the arm 23 is pivoted, not only a position of the sheet supply roller 22 in the up-down direction but also a position of the sheet supply roller 22 in the front-rear direction changes. As a result, a contact position of the sheet supply roller 22 and the sheet S shifts in the front-rear direction. If the contact position thus shifts, there may arise a possibility that the sheet supply roller 22 cannot give the rotation roller 24 the pressing force or a possibility that the sheet S cannot be nipped between the sheet supply roller 22 and the rotation roller 24 in a case where only one rotation roller 24 is provided.

In the sheet supplier 302, a plurality of the rotation rollers 24 are provided over a shift range which ranges, in the front-rear direction, from the contact position in a case where a maximum number of the sheets S are placed on the sheet supply tray 41 to the contact position in a case where a single sheet S is placed on the sheet supply tray 41. A supporter 325 supporting the rotation rollers 24 includes: a friction pad 52 which is common to the rotation rollers 24 and which supports the rotation rollers 24 from below; and two pairs of the stoppers 51 (not illustrated in FIG. 7A) for each rotation roller 24, for limiting a movement of the rotation rollers 24. According to this modified embodiment, even when the number of the sheets S placed on the sheet supply tray 41 changes, the sheet supply roller 22 applies the pressing force with respect to at least any one of the rotation rollers 24, whereby the sheet S can be nipped by the sheet supply roller 22 and the rotation roller 24 to which the pressing force is given by the sheet supply roller 22. As a result, the sheet S can be appropriately conveyed even when only a single sheet S is placed on the sheet supply tray 41 while the sheet supplier 302 prevents an occurrence of the multiple feeding of the sheets S.

Figure 7B:
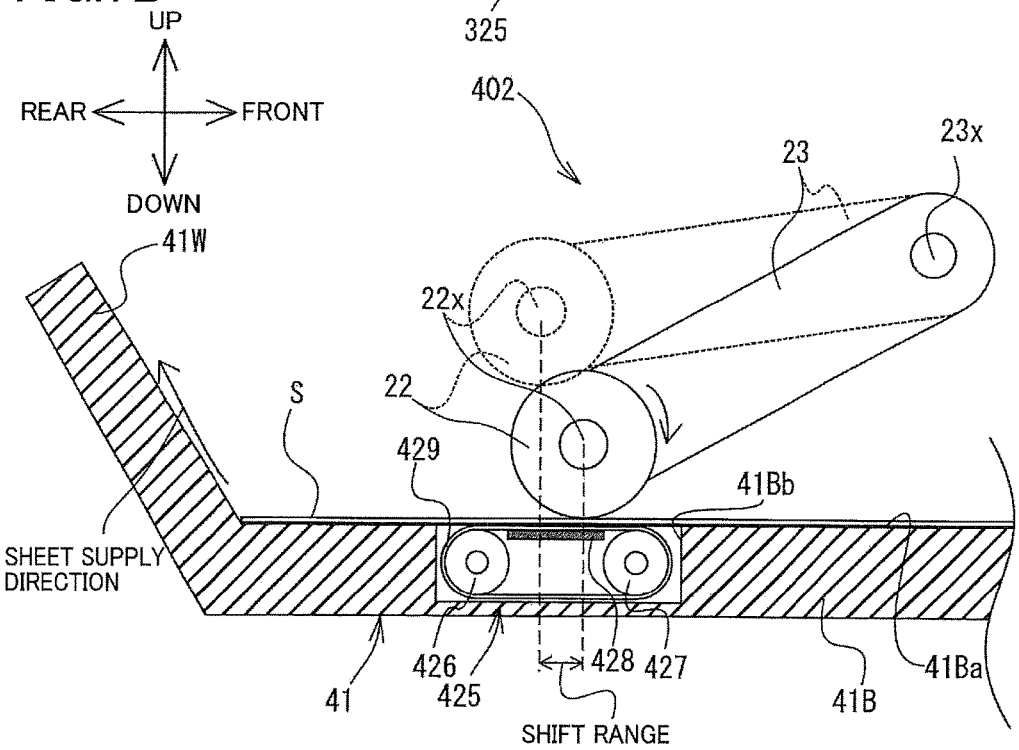
FIG. 7B is a fragmentary sectional view of a sheet supplier according to a modified embodiment.

A sheet supplier 402 shown in FIG. 7B will be explained. The sheet supplier 402 differs from the sheet supplier 2 in the structures of the rotational member and the supporter. In the sheet supplier 402, an endless belt 429 functions as the rotational member. A supporter 425 includes two pulleys 426, 427 and a friction pad 428. The pulleys 426, 427 are disposed so as to be spaced apart from each other in the front-rear direction. The belt 429 is looped over the two pulleys 426, 427. An outer surface of the belt 429 at an upper portion of the loop of the belt 429 is held in contact with the sheet S placed on the support surface 41Ba. The friction pad 428 is held in contact with an inner surface of the belt 429 at the upper portion of the loop of the belt 429, so as to support the belt 429 on an inner side of the loop of the belt 429. The friction pad 428 is provided at least over the shift range of the contact position of the sheet supply roller 22 and the sheet S.

With the configuration described above, when the sheet supply roller 22 is pressed by the arm 23 with respect to the belt 429, the same magnitude of the normal force P is generated between the sheet supply roller 22 and the sheet S, between the sheets S placed on the support surface 41Ba, between the belt 429 and the sheet S, and between the belt 429 and the friction pad 428. A static friction coefficient between the belt 429 and the sheet S is defined as the static friction coefficient $\mu 3$, and a static friction coefficient between the belt 429 and the friction pad 428 is defined as the static friction coefficient $\mu 4$, so as to satisfy the conditions represented by the expressions (7) and (8). Thus, the sheet supplier 402 according to this modified embodiment offers advantages similar to those in the illustrated embodiment. The friction pad 428 is provided over the shift range of the contact position of the sheet supply roller 22 and the sheet S. Accordingly, even when the number of the sheets S placed on the sheet supply tray 41 changes, the sheet supplier 402 achieves appropriate conveyance even in a situation in which only a single sheet S is placed on the sheet supply tray 41 while the sheet supplier 402 prevents an occurrence of the multiple feeding of the sheets S.

A sheet supplier 502 shown in FIG. 8A will be explained. In the sheet supplier 502 according to this modified embodiment, the rotation shaft 24*x* of the rotation roller 24 is located more frontward than the roller shaft 22*x* of the sheet supply roller 22. That is, an angle $\theta b$ formed by: (i) an upstream region 41Ba1 of the support surface 41Ba located frontward of, namely, located upstream in the sheet supply direction of, a nip position (as one example of "nip portion") at which the sheets S are nipped by the sheet supply roller 22 and the rotation roller 24; and (ii) a plane connecting a center axis of the roller shaft 22*x* and the nip position is an obtuse angle. With this configuration, the sheet S can be supplied by a smaller sheet supply force. This modified embodiment will be explained in detail.

A direction in which the sheet S is supplied by the sheet supply roller 22 and the rotation roller 24 coincides with a tangential direction of the sheet supply roller 22 and the rotation roller 24 at the nip position. As shown in FIGS. 8B and 8C, a pressing force F when the sheet supply roller 22 presses the rotation roller 24 by the arm 23 is resolved into the normal force P and a biting force I parallel to the tangential direction. A direction of the biting force I is opposite to the supply direction of the sheet S. Accordingly, a larger sheet supply force is required with an increase in the biting force I.

The biting force I increases with an increase in an angle $\theta t$ formed by: a straight line connecting the pivot shaft 23*x* and the nip position; and the tangential direction (the sheet supply direction). Accordingly, the angle $\theta t$ is smaller in an arrangement of the sheet supplier 502 in which the rotation shaft 24*x* is located more frontward than the roller shaft 22*x*, i.e., an arrangement in which the angle $\theta b$ is an obtuse angle (FIG. 8C) than an arrangement in which the roller shaft 22*x* and the rotation shaft 24*x* are located at the same position in the front-rear direction, i.e., an arrangement in which the angle $\theta b$ is 90° (FIG. 8B), so that the biting force I is smaller in the arrangement shown in FIG. 8C than the arrangement shown in FIG. 8B. It is consequently possible to supply the sheet S by a smaller sheet supply force.

Figure 8A:
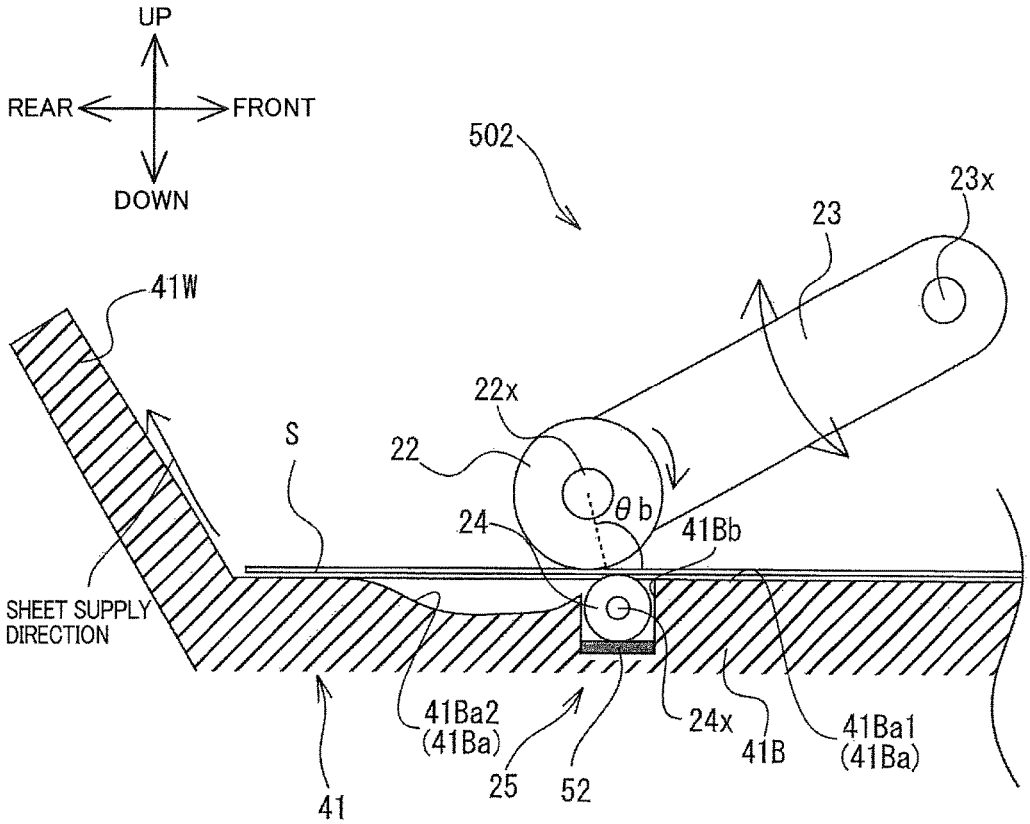
FIG. 8A is a fragmentary sectional view of a sheet supplier according to a modified embodiment.
Figure 8B:
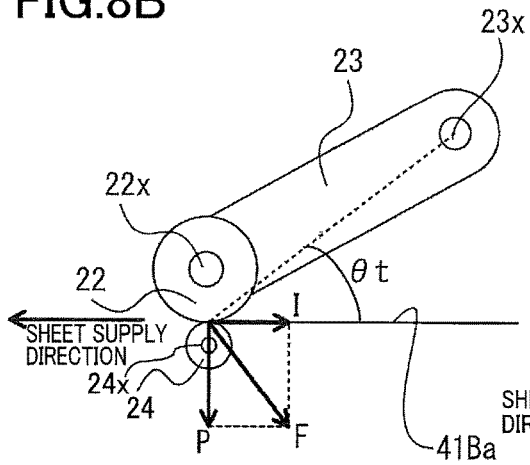
FIG. 8B is a view for explaining a biting force.
Figure 8C:
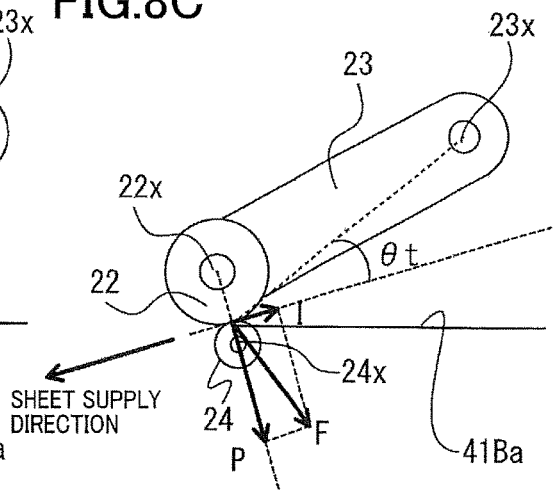
FIG. 8C is a view for explaining the biting force.

In the sheet supplier 502, the sheet supply direction in which the sheet S is supplied by the sheet supply roller 22 and the rotation roller 24 includes a vertically downward component, as shown in FIG. 8A. In view of this, a downstream region 41Ba2 of the support surface 41Ba located downstream in the sheet supply direction of, namely, located rearward of, the nip position may have a portion which is recessed downward to a level lower than the upstream region 41Ba1 and which is located within an area distant from the nip position by a predetermined distance. In this instance, a conveyance load that the sheet S receives from the support surface 41Ba is reduced, so that it is possible to convey the sheet S with a smaller sheet supply force.

While the embodiments of the present disclosure have been described above, it is to be understood that the disclosure is not limited to the details of the illustrated embodiments, but may be embodied with other various changes which may occur to those skilled in the art, without departing from the scope of the disclosure. The sheet supplying condition in the case where a single sheet S1 is placed on the support surface 41Ba may include a condition that the static frictional force ($\mu 1P$) between the sheet supply roller 22 and the sheet S1 is larger than the static frictional force ($\mu 3P$) between the rotation roller 24 and the sheet S1, for preventing an occurrence of slippage between the sheet supply roller 22 and the sheet S. In other words, the condition represented by the following expression (9) may be included:

$$\mu 1 > \mu 3 \quad (9)$$

Figure 9:
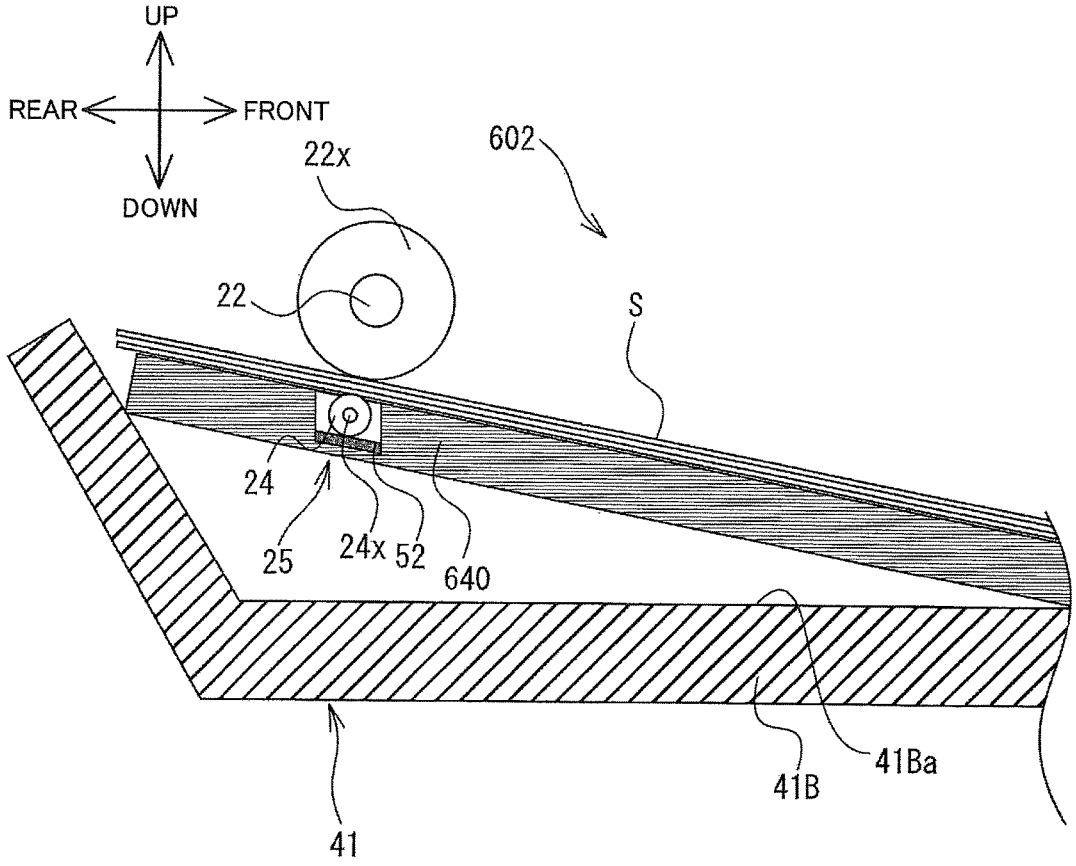
FIG. 9 is a fragmentary sectional view of a sheet supplier according to a modified embodiment.

In the illustrated embodiment, the arm 23 functions as the presser configured to press the sheet supply roller 22 with respect to the rotation roller 24. The present disclosure is not limited to this configuration. The presser may be configured otherwise as in a sheet supplier 602 shown in FIG. 9, for instance. In the sheet supplier 602, the position of the sheet supply roller 22 is fixed. Further, the rotation roller 24 is disposed in a presser plate 640 which is provided near the bottom of the sheet supply tray 41 and which is biased upward. In this configuration, the rotation roller 24 is pressed toward the sheet supply roller 22. That is, the sheet supplier 602 includes the presser plate 640 and a presser-plate moving mechanism (not shown). On the presser plate 640, rear end portions (trailing end portions) of the sheets S placed on the sheet supply tray 41 are disposed. The presser plate 640 pivots about a rotation shaft provided at its front end portion, so that a rear end portion of the presser plate 640 is moved upward and downward. The presser-plate moving mechanism is configured to move the rear end portion of the presser plate 640 upward, under the control of the controller, by an amount corresponding to a decrease in the sheets S placed on the presser plate 640 in accordance with the decrease of the sheets S. In the sheet supplier 602, the presser plate 640 includes the rotation roller 24 and the supporter 25, and the rotation roller 24 can be pressed with respect to the sheet supply roller 22.

In the illustrated embodiment, the conveyance path 15 has a C-like shape in side view. The present disclosure is not limited to this configuration. The conveyance path may be straight at a portion from the sheet supplier to the printer portion 3. In this case, the printing surface of each of the sheets S placed on the sheet supply tray 41 faces toward the sheet supply roller 22, and the non-printing surface thereof faces toward the support surface 41Ba.

The printer portion 3 is not limited to the ink-jet printing device but may be a thermal or laser printing device. The present disclosure may be applicable to a facsimile, a copying machine, or a multi-function peripheral other than the printer. The sheet supplier need not necessarily have a recording portion. The sheet is not limited to paper but may be a cloth, for instance.

What is claimed is:

1. A sheet supplier, comprising:

a tray including a support surface configured to support a plurality of sheets;

a sheet supply roller configured to supply, in a sheet supply direction, a first sheet which is an uppermost one of the plurality of sheets supported on the support surface by rotating about a roller shaft while the sheet supply roller is held in contact with the first sheet;

a rotational member configured to be rotatable and to be held in contact with a second sheet which is a lowermost one of the plurality of sheets supported on the support surface in a state in which the plurality of sheets are interposed between the rotational member and the sheet supply roller;

a presser configured to press the sheet supply roller relative to the rotational member; and a supporter including a contact portion contacting the rotational member, the supporter being configured to support the rotational member by the contact portion such that the rotational member is rotated by a movement, in the sheet supply direction, of the second sheet with which the rotational member is held in contact and to limit a movement of the rotational member caused by a force of the second sheet in the sheet supply direction;

wherein, where a static friction coefficient between the sheet supply roller and the first sheet is defined as $\mu 1$, a static friction coefficient between the plurality of sheets supported on the support surface is defined as $\mu 2$, a static friction coefficient between the rotational member and the second sheet is defined as $\mu 3$, and a static friction coefficient between the rotational member and the contact portion of the supporter is defined as $\mu 4$, the following expressions are satisfied: $\mu 1 > \mu 4 > \mu 2$, $\mu 3 > \mu 4$.

2. The sheet supplier according to claim 1, wherein the rotational member is a roller, and wherein the contact portion of the supporter is a pad contacting an outer circumferential surface of the roller.

3. The sheet supplier according to claim 1, wherein the supporter includes a pair of stopper walls disposed so as to sandwich the rotational member therebetween in the sheet supply direction and configured to limit a movement of the rotational member in the sheet supply direction and a movement of the rotational member in a direction opposite to the sheet supply direction.

4. The sheet supplier according to claim 1, wherein the rotational member is a roller, and wherein the contact portion of the supporter is a shaft that rotatably supports the roller.

5. The sheet supplier according to claim 1, wherein the rotational member is an endless belt, and wherein the supporter includes:

a plurality of pulleys over which the endless belt is looped; and a pad, as the contact portion, contacting and supporting the endless belt on an inner side of the endless belt.

6. The sheet supplier according to claim 1, wherein the presser includes an arm supporting the roller shaft of the sheet supply roller and a shaft support portion supporting the arm about a pivot shaft, wherein the pivot shaft is disposed at a position in the sheet supply direction which is different from a position of the roller shaft in the sheet supply direction and which is farther from the support surface than the roller shaft, and wherein the sheet supplier includes a plurality of rotational members, each as a rotational member, arranged in the sheet supply direction over a range in which a contact position of the sheet supply roller and the first sheet shifts by a pivotal movement of the arm.

7. The sheet supplier according to claim 1, wherein the presser includes an arm supporting the roller shaft of the sheet supply roller and a shaft support portion supporting the arm about a pivot shaft, wherein the pivot shaft is disposed upstream of the roller shaft in the sheet supply direction, and wherein an angle formed by: (i) a region of the support surface located upstream, in the sheet supply direction, of a nip portion at which the plurality of sheets are nipped between the sheet supply roller and the rotational member; and (ii) a plane connecting the roller shaft and the nip portion is an obtuse angle.

* * * * *